US005928018A

United States Patent [19]

Dumoulin

[11] Patent Number: 5,928,018

[45] Date of Patent: Jul. 27, 1999

[54] ROTARY CONTACTOR FOR AUTOMOBILE STEERING WHEEL

[75] Inventor: Marc Dumoulin, Lisses, France

[73] Assignee: Valeo Electronique, France

[21] Appl. No.: 08/931,358

[22] Filed: Sep. 16, 1997

[51] Int. Cl.[6] ..... H01R 35/04

[52] U.S. Cl. ..... 439/164; 439/15

[58] Field of Search ..... 439/164, 15

[56] References Cited

U.S. PATENT DOCUMENTS

| | | | |
|---|---|---|---|
| 4,867,688 | 9/1989 | Suzuki | 439/15 |
| 5,046,951 | 9/1991 | Suzuki | 439/164 |
| 5,171,153 | 12/1992 | Kubota et al. | 439/164 |
| 5,242,309 | 9/1993 | Hasegawa | 439/164 |

FOREIGN PATENT DOCUMENTS

| | | | |
|---|---|---|---|
| 4-162383 | 6/1992 | Japan | 439/164 |

*Primary Examiner*—Gary Paumen

*Attorney, Agent, or Firm*—Liniak, Berenato, Longacre & White

[57] ABSTRACT

A rotary contactor, comprising two coaxial parts which are mounted for movement in rotation of one with respect to the other against a flexible tape (8) providing electrical connection and wound between the said parts (2, 7) by being attached at one of its ends to one of the said parts and at its other end to the other said part, in which one of the said parts (2, 7) comprises a rotatable hub (2) and the other part a fixed hollow housing (7), in the interior of which the hub (2) is mounted, the said contactor including, firstly, a rotor (5) mounted for rotation in the housing (7), and secondly, an epicyclic gear train (40, 4, 20) carried by the housing (7) and by the hub (2) and the rotor (5), for driving the rotor (5) in rotation through the hub (2) and for reducing the number of turns between the hub (2) and the housing (7), the rotor (5) carrying, for rotation on the rotor, a pinion (4) adapted to mesh with a set of teeth (40) formed in the interior of the housing (7) and a set of teeth formed on the hub (2) on the outside of the latter: that the teeth (41, 141, 241) of the pinion (4) are resilient transversely, that is to say in the circumferential direction with respect to the pinion (4).

10 Claims, 3 Drawing Sheets

ROTARY CONTACTOR FOR AUTOMOBILE STEERING WHEEL

BACKGROUND OF THE INVENTION

The present invention relates to rotary contactors, in particular for motor vehicles, of the kind comprising two coaxial parts which are mounted for movement in rotation of one with respect to the other against a flexible tape providing electrical connection and wound between the said parts by being attached at one of its ends to one of the said parts and at its other end to the other said part.

Such a contactor is described for example in the French patent application filed on the Sep. 7, 1995 under the number 95 10 691 and published under the number 2 738 677.

As is well known, the flexible tape includes one or more electrical conductors and an insulator for insulating the conductors from each other, and provides electrical connection between the two parts without microswitching.

The rotary contactor provides electrical connections for the purpose of, for example, controlling an inflatable air bag for the protection of the driver, or for controlling the horn from the steering wheel.

With this type of contactor a problem arises because it is necessary to be able to perform for example 2.5 turns of the steering wheel in one direction and 2.5 turns of the steering wheel in the other direction.

Thus the tape winds and unwinds, and has to be of great length in order to satisfy rotation of the order of 5 turns which is necessary in most motor vehicles, this rotation being limited by end stops or by the tension in the tape.

The length of the tape is therefore variable according to the winding and unwinding diameters; in general terms, the length of these tapes is of the order of 3 to 6 meters, and this contributes to the cost of the rotary contactor to a considerable extent, especially having regard to the number of paths or conductors provided by the tape.

It is equally desirable to reduce the radial size of such a contactor installed below the steering wheel in a location close to numerous electrical devices such as switches.

In practice, the internal diameter of the hub is a function of the diameter of the steering shaft which extends through the fixed steering column of the vehicle, which therefore dictates the value of the hub diameter.

It has been proposed in the above mentioned Application to provide a rotary contactor in which one of the parts comprises a rotatable hub and the other part a fixed hollow housing, the said contactor including, firstly, a rotor mounted for rotation in the housing, and secondly, an epicyclic gear train carried by the housing and by the hub and the rotor, for driving the rotor in rotation through the hub and for reducing the number of turns between the hub and the housing, the rotor having passage means for the flexible tape and carrying, for rotation on the rotor, a pinion adapted to mesh with a set of teeth formed in the interior of the housing and a set of teeth formed on the hub on the outside of the latter.

If the reduction in length of the tape and in the size of the contactor is obtained with a contactor of this type, the presence of an epicyclic gear train involves the risk of making such a contactor noisy.

SUMMARY OF THE INVENTION

The object of the present invention is to overcome this drawback.

Thus, according to the invention a rotary contactor, especially for motor vehicles, of the kind comprising two coaxial parts which are mounted for movement in rotation of one with respect to the other against a flexible tape providing electrical connection and wound between the said parts by being attached at one of its ends to one of the said parts and at its other end to the other said part, in which one of the said parts comprises a rotatable hub and the other part a fixed hollow housing, in the interior of which the hub is mounted, the said contactor including, firstly, a rotor mounted for rotation in the housing, and secondly, an epicyclic gear train carried by the housing and by the hub and the rotor, for driving the rotor in rotation through the hub and for reducing the number of turns between the hub and the housing, the rotor having passage means for the flexible tape, wherein the rotor carries for rotation on the rotor, a pinion adapted to mesh with a set of teeth formed in the interior of the housing and a set of teeth formed on the hub or the outside of the latter, is characterised by the fact that the teeth of the pinion are resilient transversely, that is to say in the circumferential direction with respect to the pinion.

Preferably, the elasticity of the teeth is obtained by means of a slot which extends generally radially and which is formed in the teeth in their central part.

The slot is preferably straight; in another version it is oblong.

Preferably, the working flank of each tooth is a development of a circle, and its connecting flank is of the concave type.

The slot preferably extends radially to the foot surface of the pinion.

Preferably, the rotor carries a pin for carrying the pinion for rotation thereon, and in that the set of teeth of the pinion and the set of teeth of the hub are continuous.

Preferably, the working surface of the teeth is inclined, defining a so-called rake angle with a direction parallel to the axis of the pinion, so that the pinion is subjected to an axial force which applies it against the rotor, and this further minimises operating noise in the gear train; the sets of teeth with which the pinion cooperate consist of plain teeth.

Preferably, the passage means consist of a slot formed in an axially oriented annular skirt of the rotor for winding of the flexible tape thereon, and in that one of the edges of the slot is rounded for turning the said tape around it.

Thanks to the invention, any clearance is avoided, firstly between the pinion and the set of teeth on the hub, and secondly between the pinion and the set of teeth on the housing; in this way the occurrence of noise is prevented.

BRIEF DESCRIPTION OF THE DRAWINGS

In order to enable the invention to be better understood, one embodiment, shown in the attached drawings, will now be described by way of example, purely by way of illustration and without limitation.

In the drawings.

DETAILED DESCRIPTION OF THE PREFERRED EMBODIMENT

Figure 1:
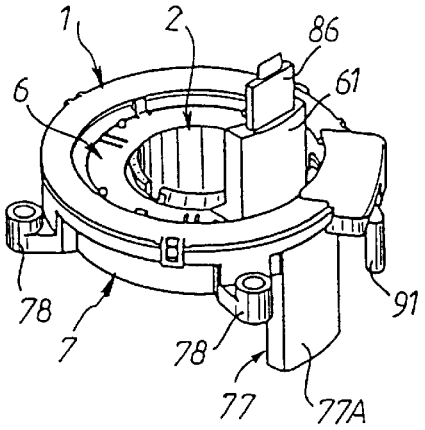
FIG. 1 is a perspective view of the rotary contactor.
Figure 1:
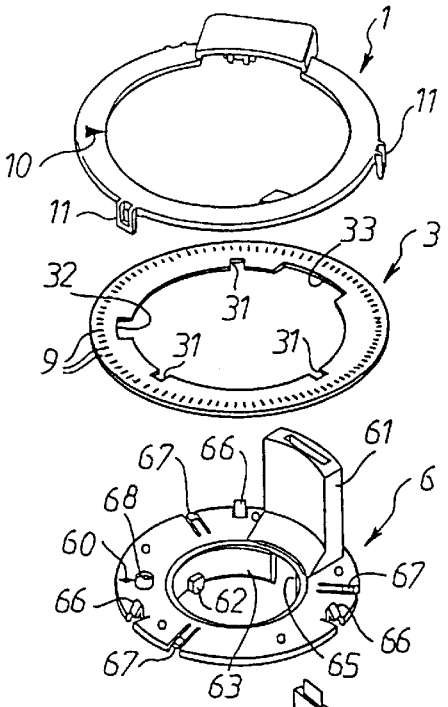
Figure 2:
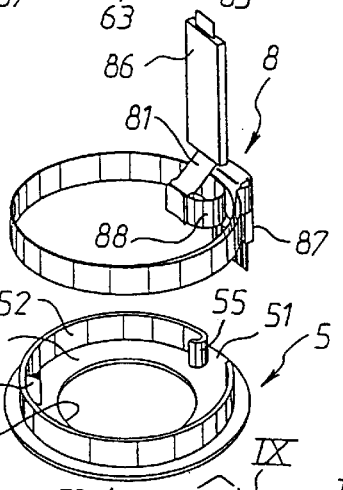
FIG. 2 is an exploded view of the contactor of FIG. 1.
Figure 3:
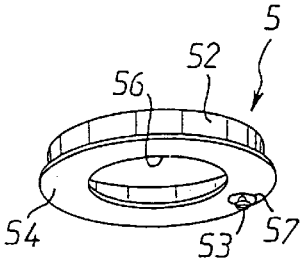
FIGS. 3 and 5 are views of the rotor and the hub, taken respectively from FIG. 2 but viewed from the other side.

FIGS. 1 to 12 show a rotary contactor for a motor vehicle, of the kind comprising two coaxial parts 2, 7 which are mounted for rotating movement of one with respect to the other against the action of a flexible tape 8 which provides electrical connection and which is wound between the said parts, being attached at one of its ends to one of the said parts, and at its other end to the other one of the said parts.

In this example, one of the parts comprises a rotatable hub 2 which is arranged to be coupled in rotation to the steering wheel of the vehicle, and a fixed housing 7 which is secured to the fixed steering column of the vehicle via the switch support which is located below the steering wheel and which is not shown. The hub 2 is mounted within the hollow housing 7.

With a view to reducing the length of the flexible tape 8, and reducing the overall external size of the housing 7, the rotary contactor includes a rotor 5 which is mounted for rotation on the hub 2, being contained in the housing 7, together with an epicyclic gear train 40, 20, 4 carried by the fixed housing 7, the movable hub 2, and the rotor 5, so as to drive the rotor 5 in rotation through the hub 2 and to reduce the number of turns between the movable hub 2 and the fixed housing 7.

The rotor 5 has passage means 51 for the flexible tape 8. These means 51 consist here of a slot to be described later herein.

More precisely, in the drawings the rotary contactor comprises an assembly of components of plastics material, namely a protector 1, the movable hub 2, a phonic wheel 3, a pinion 4, the rotor 5, a cover member 6, and the housing 7. These components are of hollow annular form.

These components are preferably formed by moulding. The housing 7 in this example is monobloc and has a transversely oriented base portion 74 joined to the outer periphery of an axially oriented annular skirt 72. The base portion 74 has a central hole 70.

Internally, the skirt 72 includes an internal set of teeth 40 bounded axially by a transversely oriented smooth wall 71, which is extended by two successive cylindrical walls 73 and 75, the diameters of which increase in succession. The internal bore of the housing 7 is thus stepped. The set of teeth 40, the teeth of which are arranged in a development of a circle, is bounded axially, on the side opposite to the transverse wall 71, by the base portion 74 of the housing 7.

The housing 7 also has a side aperture 76 of substantially rectangular shape, to enable the flexible, electrically connecting tape to pass out of the housing for connection to the incorporated electrical connector. In this example, a chimney 77 extends radially outwards from the aperture 76.

The fixed housing 7 therefore has a hollow annular form, and in this example it carries ears 78 for fastening the housing 7 to the switch support which is located under the steering wheel of the vehicle, and which is connected to the end of the steering column. In another version, the housing 7 may be formed directly in the central portion of the said switch support, which reduces the number of components.

Contained within the housing 7 is the rotor 5, around which the flexible, electrically conductive tape 8 winds or unwinds, the tape having, encapsulated within an electrical insulator, a number of electrical paths or conductors, such as flattened conductive wires, which are determined according to the application and the number of information signals that are to pass between the fixed steering column and the rotatable steering wheel. The tape partly determines the thickness of the rotary contactor.

The ends of the conductive tape 8 are fixed to connectors 86 and 87 respectively; these connectors are oriented axially, one of them, namely the connector 86, extending upwardly while the other one, namely the connector 87, is directed downwards; the connector 86 is adapted to pass through an axial chimney 61 which is a projecting portion of the cover member 6, and which extends from the upper face of the latter; thus, the connector 86, when it is fitted in the chimney 61, is fixed to the latter for rotation with it; the chimney 61 is the element by means of which the rotary contactor is driven in rotation by the steering wheel of the vehicle.

The hub 2, which has a sleeve portion 23, is mounted for rotation on the housing 7 by means of a cylindrical surface 21 of the hub, this surface being adapted to cooperate with the edge of the central hole 70 in the housing 7. The cylindrical surface 21 terminates in a transverse flange 22, which provides an axial abutment for the hub 2 in cooperation with the external face of the base portion 74 of the housing 7.

The sleeve portion 23 of the hub 2 is provided with two longitudinal slots 24 which are arranged to receive driving nibs 62 arranged on the inner face of a skirt portion 63 carried by the annular face plate portion 64 of the cover member 6.

The skirt portion 63 has a slot 65 on its face opposite to that which carries the chimney 61, to allow the bent end 81 of the tape 8 to pass through it for connection to the connector 86.

The sleeve portion 23 of the hub 2 has a terminal return lip 25 of triangular cross section, for clipping engagement of this lip 25 with the upper edge of the skirt portion 63 of the cover member 6.

Thus, when the rotary contactor is assembled, the hub 2 and the cover member 6 are coupled together axially and in rotation.

The rotor 5 is generally annular in shape and includes an axially oriented annular peripheral skirt portion 52 which is joined through one of its branches (namely its lower branch, FIGS. 2, 3 or 7) to a transverse face plate portion 54. The face plate portion 54 carries, projecting axially in its lower part and on the side opposite to its skirt portion 52, an integral pivot 53 for receiving the pinion 4.

It will be noted that the free end of the skirt portion 63 of the cover member 6 enables the rotor 5 to be mounted for rotation by cooperation, with the said free end, of the inner edge of the central aperture 56 of the face plate portion 54 of the rotor 5, so that there is a space between the skirt portion 63 and the internal bore of the skirt portion 52, for accommodating the tape and to enable the latter to be wound around the skirt portion 63.

The skirt portion 52 has the slot 51 through which the tape 8 passes, the depth of the slot 51 being a function of the height of the tape 8.

One of the edges bounding the slot 51 is rounded at 55, so as to enable the tape 8 to be turned on it without damaging the tape, in a manner to be described later herein. The rounded portion extends between the skirt portion 52 and the skirt portion 63.

It will be noted that the hub 2 also has, projecting at its outer periphery, a set of teeth 20 which is formed in a thickened portion of the hub at its outer periphery adjacent to its flange.

Thus, the epicyclic gear train in this example comprises the sets of teeth 40, 20, together with the pinion 4 mounted for rotation on the pin 53, which is cylindrical and thus constitutes a spindle fixed to the rotor 5.

The pinion 4 drives the rotor 5 in step-by-step rotation, in cooperation with the set of driving teeth 20 of the hub 2 and the set of fixed teeth 40 of the housing 7.

The conjugation of the three elements 40, 20, 4 constitutes an epicyclic gear train having a multiplication ratio which enables a tape of short length to be used.

As will be understood, the number of teeth in the set of teeth 20 in the hub 2 is so chosen as to obtain the multiplication ratio appropriate to the dimensions of the rotary contactor, so that the set of teeth 20 may be either continuous or discontinuous.

In this example, the tape 8 is an extruded multi-conductor cable; its flexibility enables it to undergo the bending necessary for the principle of operation of the rotary contactor. Its two ends are bent back at 90 degrees so as to enable it pass directly out towards the connectors, thus avoiding any intermediate connection.

Preferably, the electrical insulation of the tape 8 is of a generally silent material with a low coefficient of friction. It is based for example on polyamide, or a copolymer of tetrafluoroethylene, which is stable at temperatures between −55 and 150. The electrical conductors of the tape are preferably flattened wires.

In the example shown, the housing 7 includes a pocket 79 for a steering wheel angle sensor, the information from which can be processed, in particular by the computer of a suspension system of the so-called intelligent type; the position of the steering wheel being represented by that of the cover member 6, the said angle sensor reads marks 9 which are traced on a wheel 3 of the so-called phonic type, which is in the form of an annulus fixed to the cover member 6; this fixing is obtained by means of clip elements 66 cooperating with the upper face of the phonic wheel 3, and notches 31 formed on the inner periphery of the said wheel 3; these clip elements 66 apply the wheel 3 elastically against the cover member 6, and more precisely against abutment elements 67 formed on the latter, which are also elastic by virtue of radial slots by which they are flanked. Part of the cable by which the sensor is supplied with power, and through which its output signals are passed, is indicated at 91.

A generally annular protector 1 covers and protects the wheel 3, and closes off the pocket 79 for the sensor; the protector 1 is attached to the housing 7 by means of axial lugs 11 formed with holes and adapted to cooperate with radial nibs 82 formed on the outer periphery of the housing 7.

Like the cover member 6, the hub 2, coupled to the steering wheel, has a position which represents that of the latter; it is therefore possible to make use of the hub 2 for controlling certain items of equipment; for example, an axial tongue, such as the tongue 26, may be used for automatic cancellation of the control for the flashing direction indicators of the vehicle.

Figure 4:
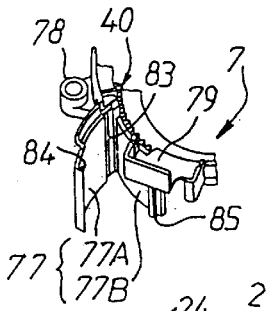
FIG. 4 is a partial view of the housing seen in the direction of the arrow IV in FIG. 2.
Figure 4:
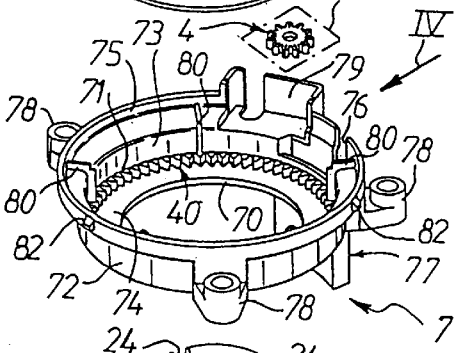
Figure 5:
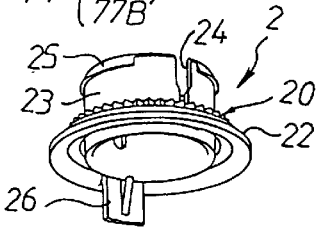
Figure 5:
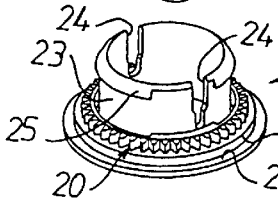

The chimney 77 of the housing 7 is in two parts, which are fixed to the housing, one of these parts, 77B, being fixed with respect to the latter, with the other one, 77A, being movable with respect to the first part in the manner of a door, by means of a thin axial hinge 83; the door element 77A is locked in its closed position by clipping engagement of the free axial end 84 of the door element 77A on a complementary axial means 85 carried by the housing 7, FIG. 4.

At the inner periphery of its skirt 72, the housing 7 carries lateral guide elements 80 which project with respect to the latter and extend axially, for guiding the tape 8 radially so as thus to limit the zones of contact of the tape 8 with the housing 7, and therefore the friction involved.

The protector 1 carries on its outer face a mark 10, which is accordingly a mark fixed with respect to the housing 7.

The cover member 6 also carries a mark 60 which enables its relative position with respect to the housing 7 to be identified; the mark 60 is always visible even when the protector 1 is in place together with the phonic wheel 3, which is formed with a notch 32 for this purpose; a further notch, namely the notch 33, is suitably configured so as to enable the phonic wheel 3 to pass around the chimney 61 of the cover member 6.

In line with the mark 60, but on a slightly smaller radius, the cover member 6 has a window 68. This window 68 is on a radius which is equal to that on which the rotor 5 carries a mark 50, such that, for a certain relative angular position of the cover member 6 and rotor 5, the mark 50 on the rotor 5 is visible through the window 68 of the cover member 6, the components of the contactor being positioned in axial relationship when the contactor is assembled, in the order in which they are shown in vertical succession in FIG. 2.

The purpose of the marks 10, 60 and 50 will appear below.

In this embodiment, the rotary contactor is of the type in which the tape is in a central position when the steering wheel is also in a central position, that is to say in the position that corresponds to steering straight ahead. As is well known, this type is of advantage because it enables a short tape to be used. With a steering wheel arranged to make a total of five turns, two and a half turns can then be made from this central position in each direction of rotation, i.e. to left and right; the same will then be true for the cover member 6 and the hub 2 of the contactor.

In order that the length of the tape 8 shall be no longer than is necessary for operation, it is desirable to be certain, when fitting the contactor on the steering wheel while the steered road wheels of the vehicle are pointing straight ahead, that the tape 8 is truly in its central position. This is achieved here in a simple and reliable way by means of the marks 10, 60 and 50 and the window 68 in the cover member 6.

In this embodiment the selected reduction ratio obtained by means of the epicyclic gear train is two and a half, so that when the cover member 6, and therefore the hub 2, performs five turns, the rotor 5 only makes two turns.

Fitting of the tape 8 in its central position is simple, and is carried out in the following way.

The hub 2 and the rotor 5, with its pinion 4, are put in place axially within the housing 7 through each of its ends; the door element 77A of the housing 7, and more precisely of the connector 77, is open.

The connector 86 is inserted into its chimney 61 from below with respect to the cover member 6; at the end of the travel of this insertion, means not shown lock the connector 86 in position in the chimney 61 and retain it there axially.

The cover member 6, equipped with the tape 8, is brought down towards the housing 7, the tape being unwound except for its loop 88, which embraces the rounded edge 55 of the slot 51 in the rotor 5. The cover member 6 and the hub 2 are then axially clipped together.

Figure 15:
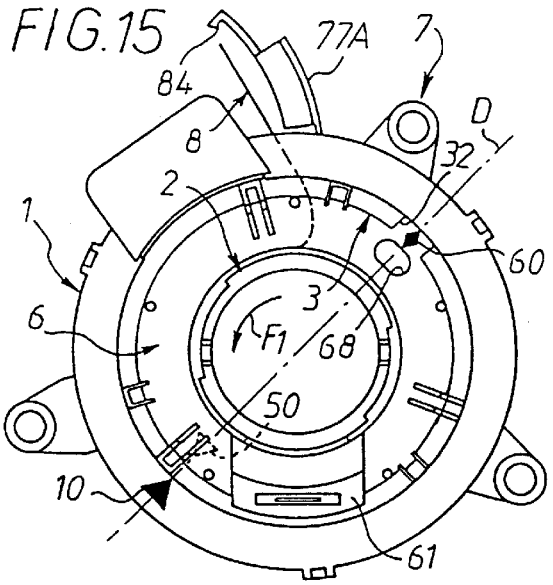
FIGS. 15 to 19 show the various steps in the fitting of the tape, with FIG. 19 showing the contactor ready to be fitted on the steering column of the vehicle.

The components are now in the relative position shown in FIG. 15.

In this Figure, it will be seen that the position of the components is shown by the marks 10, 50 and 60, although the mark 50 is not visible. The three marks 10, 50 and 60 are aligned on a diameter D; the marks 10 and 60 are diametrically opposed to each other; the mark 50 is in line with the mark 10; the door element 77A being open, the tape 8 is spread out towards the outside of the contactor.

From this position, the cover member 6 is turned in the direction of the arrow F1 through five turns; the rotor 5 having therefore performed two complete turns, the marks 50 and 60 are once again in the same position with respect to the mark 10; the connector 87 is then in place in the part 77B of the chimney 77, and the door element 77A is closed; means, not shown, again lock the connector 87 in the chimney 77.

Figure 6:
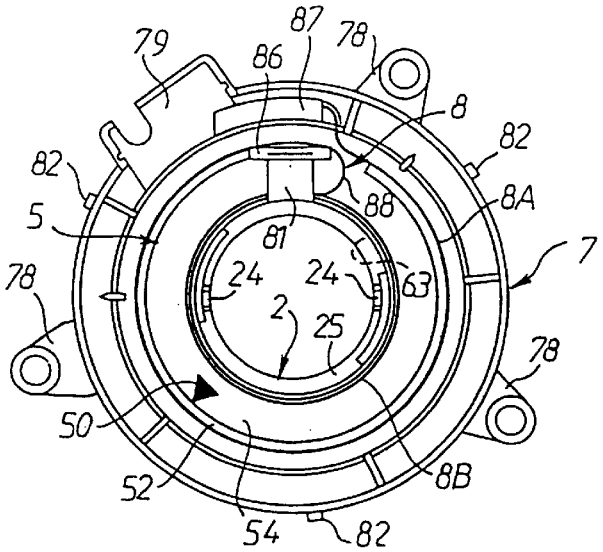
FIG. 6 is a top plan view of the contactor when open.
Figure 8:
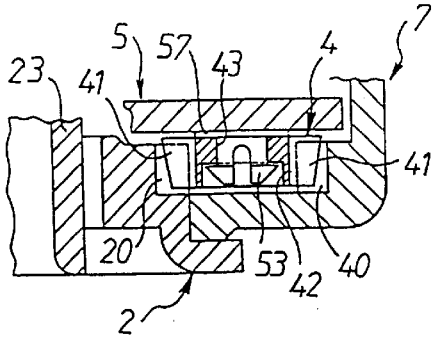
FIG. 8 is a scrap view in cross section showing the mounting of the pinion.
Figure 9:
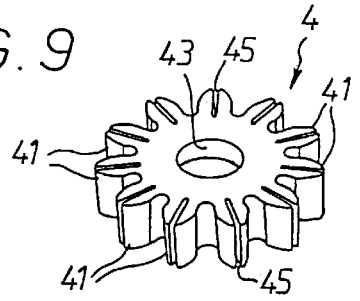
FIG. 9 is an enlarged view of the item denoted in FIG. 2 by the box IX.
Figure 7:
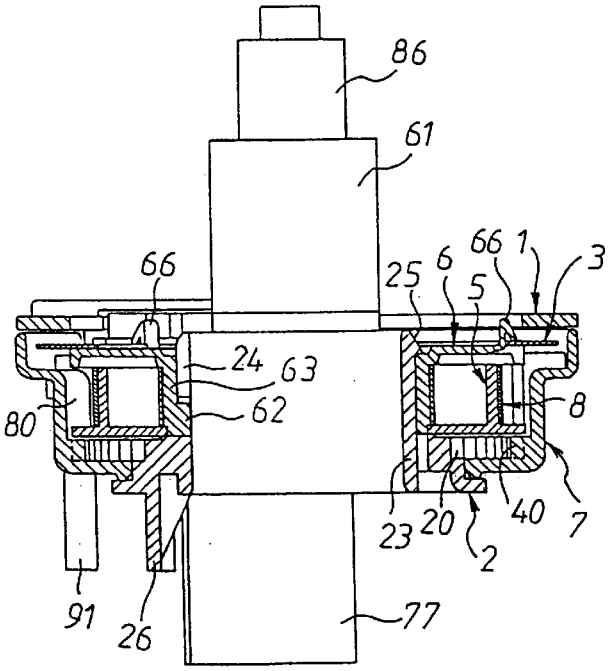
FIG. 7 is a view in cross section taken on the line VII—VII in FIG. 19.

After this operation, the tape 8 is in the position shown in FIG. 6: a first portion 8A, from the loop 88 to the connector 87, is outside the skirt portion 52 of the rotor, which it surrounds for about one turn, while a second portion 8B, extending from the loop 88 to the connector 86, is inside the said skirt portion 52 and surrounds the skirt portion 63 of the cover member 6 over about two turns.

Figure 16:
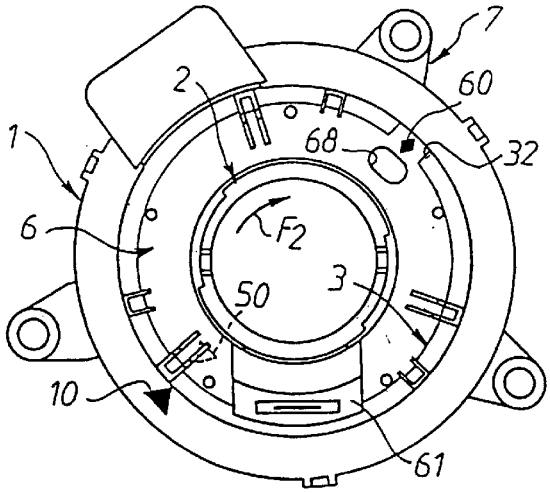
Figure 17:
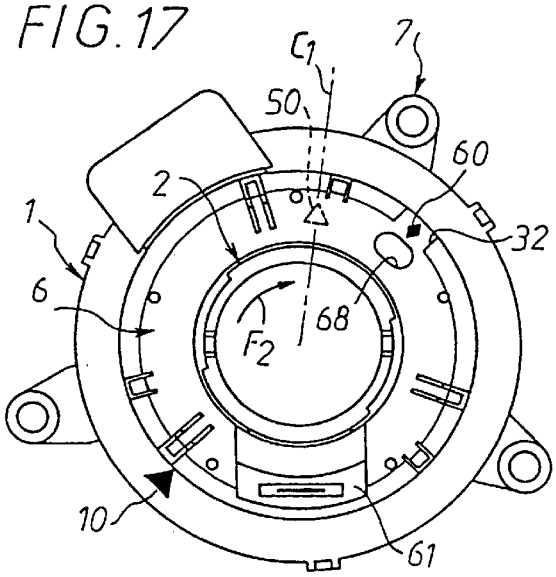
Figure 18:
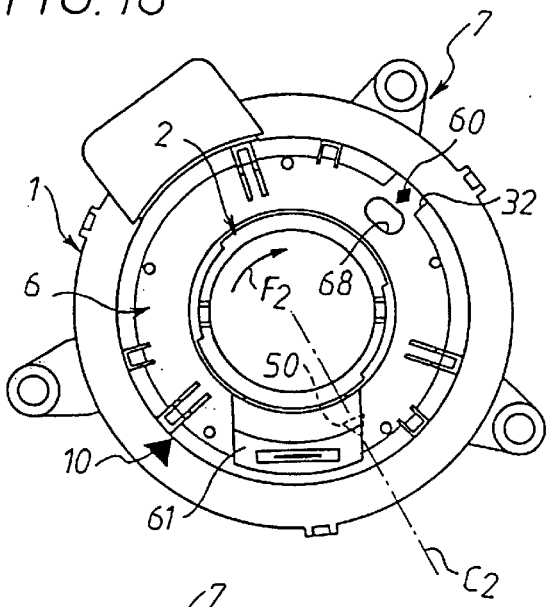
Figure 19:
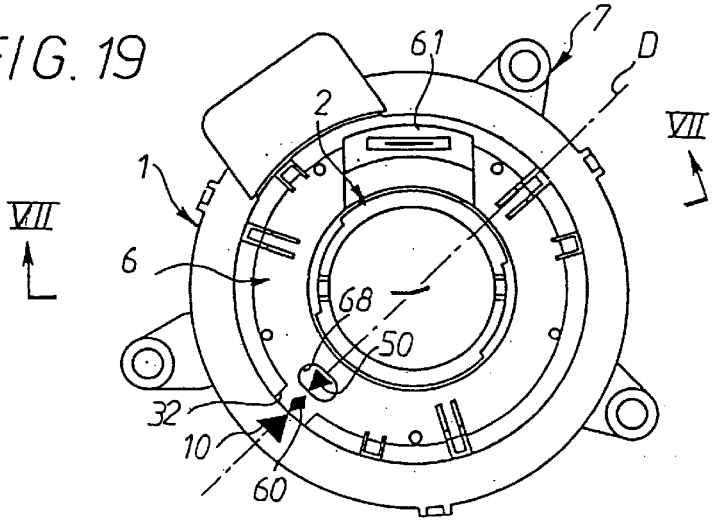

From the position just described, which is illustrated in FIG. 16, the cover member 6 is turned in the direction of the arrow F2; in FIG. 17, the cover member 6 has just performed one turn: the rotor 5 has therefore performed 0.4 of a turn, and its mark, not visible, is in line with the radius C1; in FIG. 18, the cover member 6 has performed two turns: the rotor 5 has therefore performed 0.8 of a turn, and its mark, which is in line with the radius C2, is still not visible; in FIG. 19, the cover member 6 has performed two and a half turns: its mark 60 is then in line with the mark 10, and also with the mark 50 of the rotor 5, which is accordingly visible through the window 68; thus, when the tape 8 is in its central position, the three marks 10, 60 and 50 are aligned on a common radius corresponding to the initial diameter D, and all three can be seen.

Figure 10:
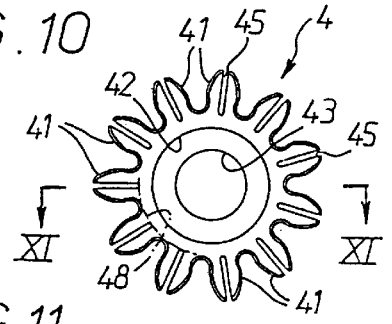
FIG. 10 is a top plan view of the pinion.
Figure 11:
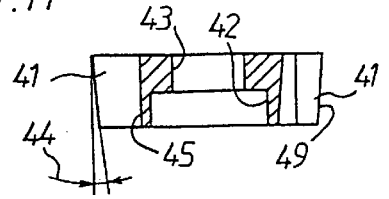
FIG. 11 is a view in cross section taken on the line XI—XI in FIG. 10.
Figure 12:
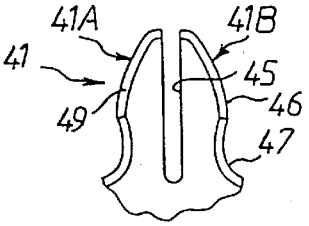
FIGS. 12 to 14 are partial top plan views of the pinion on an enlarged scale, showing one tooth of the pinion, with FIGS. 13 and 14 corresponding to different versions from that in FIG. 12, which shows one tooth of the pinion of FIGS. 10 and 11.

Referring to FIGS. 8 to 12, it can be seen that the pinion 4 has teeth 41, there being eleven teeth 41 in the example shown, the profile of which is best seen in FIG. 12; each tooth 41 is symmetrical in this embodiment; its working flank 46 is generally a development of a circle, and its connecting flank 47 is of the concave type; the tooth 41 is configured as two half teeth 41A, 41B because it includes a slot 45 which in this case is radial and straight; because of this arrangement, the teeth 41 have some degree of transverse elasticity, that is to say they are elastic in the circumferential direction of the pinion 4; the slot 45 preferably extends radially as far as the foot surface 48 of the pinion 4, FIG. 10.

Figure 13:
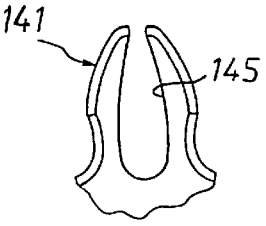
Figure 14:
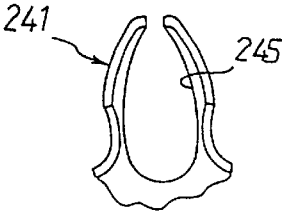

This elasticity can be varied by varying the form of the slot; thus, for example, the slot 145 of the tooth 141 in FIG. 13 is oblong; the slot 246 of the tooth 241 in FIG. 14 is also oblong but more so.

Thus, because of the said elasticity of the teeth, the latter can be fitted in slight compression between the set of teeth 20 of the hub 2 and the set of internal teeth 40, or crown, of the housing 7: consequently, meshing in the epicyclic gear train is free of any play, and operating noise from the gear train is attenuated or even suppressed.

The pinion 4 has a central bore 42, followed by a bore 43 of smaller diameter, such that the pinion 4 can be force-fitted on a pivot 53 having a head and fixed to the rotor 5. As can be seen in FIGS. 11 and 12, the working surface 49 of the teeth 41 is inclined so as to make a so-called rake angle 44 with a direction parallel to the axis of the pinion 4; consequently, when the pinion is mounted between the sets of teeth 20 and 40 which are straight teeth, the pinion 4 is subjected to an axial force which applies the pinion 4 against the rotor 5, or more precisely against a collar portion 57 of the rotor 5 which surrounds the pivot 53; thus, the pinion 4 works without any axial clearance, which again minimises or even suppresses any operating noises in the epicyclic gear train.

Thanks to the pinion in accordance with the invention, it is possible to arrange several of these circumferentially so as to improve the balancing of the forces without any risk of jamming.

It will be noted that in this embodiment, the hub 2, the pinion 4, the rotor 5, the cover member 6, and the housing 7, and therefore the epicyclic gear train 40, 4, 20, are made of mouldable plastics material such that noises are minimised even more, and friction effects are reduced.

I claim:

1. A rotary contactor, comprising two coaxial parts which are mounted for movement in rotation of one with respect to the other, a flexible tape (8) providing electrical connection and wound between said parts (2, 7) by being attached at one of its ends to one of said parts and at its other end to the other part, one of said parts (2, 7) comprising a rotatable hub (2) and the other part comprising a fixed hollow housing (7) in the interior of which the hub (2) is mounted, said contactor including a rotor (5) mounted for rotation in the housing (7) and an epicyclic gear train (40, 4, 20) carried by the housing (7) and by the hub (2) and the rotor (5), for driving the rotor (5) in rotation through the hub (2) and for reducing the number of turns between the hub (2) and the housing (7), the rotor (5) having passage means (51) for the flexible tape (8) and carrying, for rotation on the rotor, a pinion (4) adapted to mesh with a set of teeth (40) formed in the interior of the housing (7) and a set of teeth formed on the hub (2) on the outside thereof, characterised by the fact that the teeth (41, 141, 241) of the pinion (4) are resilient in the circumferential direction with respect to the pinion (4).

2. A contactor according to claim 1, characterised by the fact that the resiliency of the teeth (41, 141, 241) of the pinion is obtained by means of a slot (45, 145, 245) which extends generally radially and which is formed in the center of each of the teeth (41, 141, 241).

3. A contactor according to claim 2, characterised by the fact that each slot (45) is straight.

4. A contactor according to claim 2, characterised by the fact that each slot (145, 245) is oblong.

5. A contactor according to claim 1, characterised by the fact that a working flank (46) of each tooth (41, 141, 241) of the pinion is a development of a circle, and a connecting flank (47) of each pinion tooth is concave.

6. A contactor according to claim 2, characterised by the fact that each slot (45, 145, 245) extends radially to a foot surface (48) of the pinion (4).

7. A contactor according to claim 1, characterised by the fact that the rotor (5) carries a pin (53) for carrying the pinion (4) for rotation thereon, and in that the set of teeth of the pinion (4) and the set of teeth (20) of the hub (2) are continuous.

8. A contactor according to claim 1, characterised by the fact that a working surface (49) of the each of the pinion teeth (41, 141, 241) is inclined, defining a so-called rake angle (44) with a direction parallel to the axis of the pinion (4).

9. A contactor according to claim 8, characterised by the fact that the sets of teeth (40, 20) of the hub and housing with which the pinion (4) cooperate consist of plain teeth.

10. A contactor according to claim 1, characterised by the fact that the passage means (51) consists of a slot (51) formed in an axially oriented annular skirt (52) of the rotor (5) for winding of the flexible tape (8) thereon, and in that one of the edges of the slot (55) is rounded for turning the tape (8) around it.

* * * * *